United States Patent [19]

Fukushima

[11] Patent Number: 5,021,832

[45] Date of Patent: Jun. 4, 1991

[54] ELECTROPHOTOGRAPHIC COPIER HAVING ADDITIONAL INFORMATION RECORDING FUNCTION

[75] Inventor: Shigenobu Fukushima, Osaka, Japan

[73] Assignee: Minolta Camera Kabushiki Kaisha, Osaka, Japan

[21] Appl. No.: 406,783

[22] Filed: Sep. 13, 1989

[30] Foreign Application Priority Data

Sep. 14, 1988 [JP] Japan ..... 63-230253

[51] Int. Cl.[5] ..... G03G 21/00

[52] U.S. Cl. ..... 355/218; 355/219; 355/228

[58] Field of Search ..... 355/218, 219, 233, 238, 355/1, 75, 67, 202, 313

[56] References Cited

U.S. PATENT DOCUMENTS

| | | | |
|---|---|---|---|
| 4,551,008 | 11/1985 | Banton | 355/218 |
| 4,552,447 | 11/1985 | Sagara et al. | 355/218 |
| 4,640,601 | 2/1987 | Deguchi et al. | 355/218 |
| 4,701,044 | 10/1987 | Horiuchi et al. | 355/218 |
| 4,712,907 | 12/1987 | Weinberger et al. | 355/218 |
| 4,734,734 | 3/1988 | Yano | 355/218 |
| 4,734,789 | 3/1988 | Smith et al. | 355/202 x |
| 4,743,947 | 5/1988 | Yamamoto | 355/218 |
| 4,814,815 | 3/1989 | Shibata et al. | 355/218 |
| 4,837,598 | 6/1989 | Nonami | 355/218 |

FOREIGN PATENT DOCUMENTS 59-52811 12/1984 Japan .

*Primary Examiner*—A. T. Grimley
*Assistant Examiner*—Thu A. Dang
*Attorney, Agent, or Firm*—Willian, Brinks, Olds, Hofer, Gilson & Lione

[57] ABSTRACT

An electrophotographic copier comprises an optical system for projecting an original image onto a photoreceptor to form an electrostatic latent image thereon, and a movable LED array for forming an electrostatic latent image corresponding to additional information on the photoreceptor. A seal is applied to a bottom face of an original-supporting glass table for retaining electric charge of a selected region of the photoreceptor by partially intercepting the original image projected by the optical system. The LED array is switchable between a mode for recording the additional information on the selected region of the photoreceptor, and a mode for erasing the charge of the selected region.

12 Claims, 8 Drawing Sheets

ELECTROPHOTOGRAPHIC COPIER HAVING ADDITIONAL INFORMATION RECORDING FUNCTION

BACKGROUND OF THE INVENTION

1. Field of the Invention

The present invention relates to electrophotographic copiers having a function for recording additional information such as dates and/or page numbers.

2. Description of the Prior Art

Electrophotographic copiers having a function for recording additional information are known in the art. Copiers of this type comprise a recording head for recording additional information on a photoreceptor, besides ordinary image-forming elements for projecting an image of an original onto the photoreceptor to form an electrostatic latent image of the original thereon.

U.S. Pat. No. 4,640,601 discloses an example of such electrophotographic copiers, which comprises, in addition to a lens array for projecting an image of an original onto a photoreceptor, an LED array for recording additional information on the photoreceptor, and a shield member driven to advance to a position between the original and the lens array for preventing the original image from being projected to a region of the photoreceptor on which the additional information is to be recorded. With the copier disclosed in this U.S. patent, when the original image is projected onto the charged photoreceptor, the shield member intercepts the light directed to a partial region of the photoreceptor to retain the charge in that region. Thereafter, the region is exposed to the LED array for writing the additional information thereon. The LED array is movable axially of the photoreceptor for allowing the additional information to be recorded on a selected position of the photoreceptor.

However, the copier disclosed in the above U.S. patent must provide a space for accommodating the movement of the shield member which is movable together with the LED array. This copier is therefore unsatisfactory from the point of view of compactness.

SUMMARY OF THE INVENTION

A primary object of the present invention is to provide a compact electrophotographic copier containing elements for recording additional information.

A further object of the present invention is to provide a compact electrophotographic copier having a shield member or a light absorbing member fixedly mounted therein for preventing an original image from being projected to a region assigned for recording additional information, in which the shadow of this member does not appear on copying paper when the additional information is not recorded.

The above objects are fulfilled, according to the present invention by an electrophotographic copier comprising means for forming an electrostatic latent image corresponding to additional information, which includes shield means fixedly provided at a position corresponding to a selected position for recording the additional information, and an exposure head adjustable to a position for exposing a selected region of the photoreceptor, the shield means acting to retain electric charge of the selected region of the photoreceptor by partially intercepting an original image projected by a projecting optical system, the exposure head being operable in two modes, i.e. a first operating mode for exposing the selected region of the photoreceptor in accordance with an electric signal indicative of the additional information, and a second operating mode for erasing the charge of the selected region of the photoreceptor regardless of the electric signal, and the exposure head being movable to a position for exposing the selected region.

With the above copier, the components for recording the additional information according to the present invention are greatly simplified. The construction may be further simplified where the shield means is realized by applying a seal or the like to a selected position of the original-original supporting glass table (corresponding to the additional information recording region of the photoreceptor).

The foregoing and other objects, features and advantages of the invention will be apparent from the following more particular description of preferred embodiments of the invention, as illustrated in the accompanying drawings.

DESCRIPTION OF THE PREFERRED EMBODIMENTS

1: Outline of Copier According to the Invention

Figure 1:
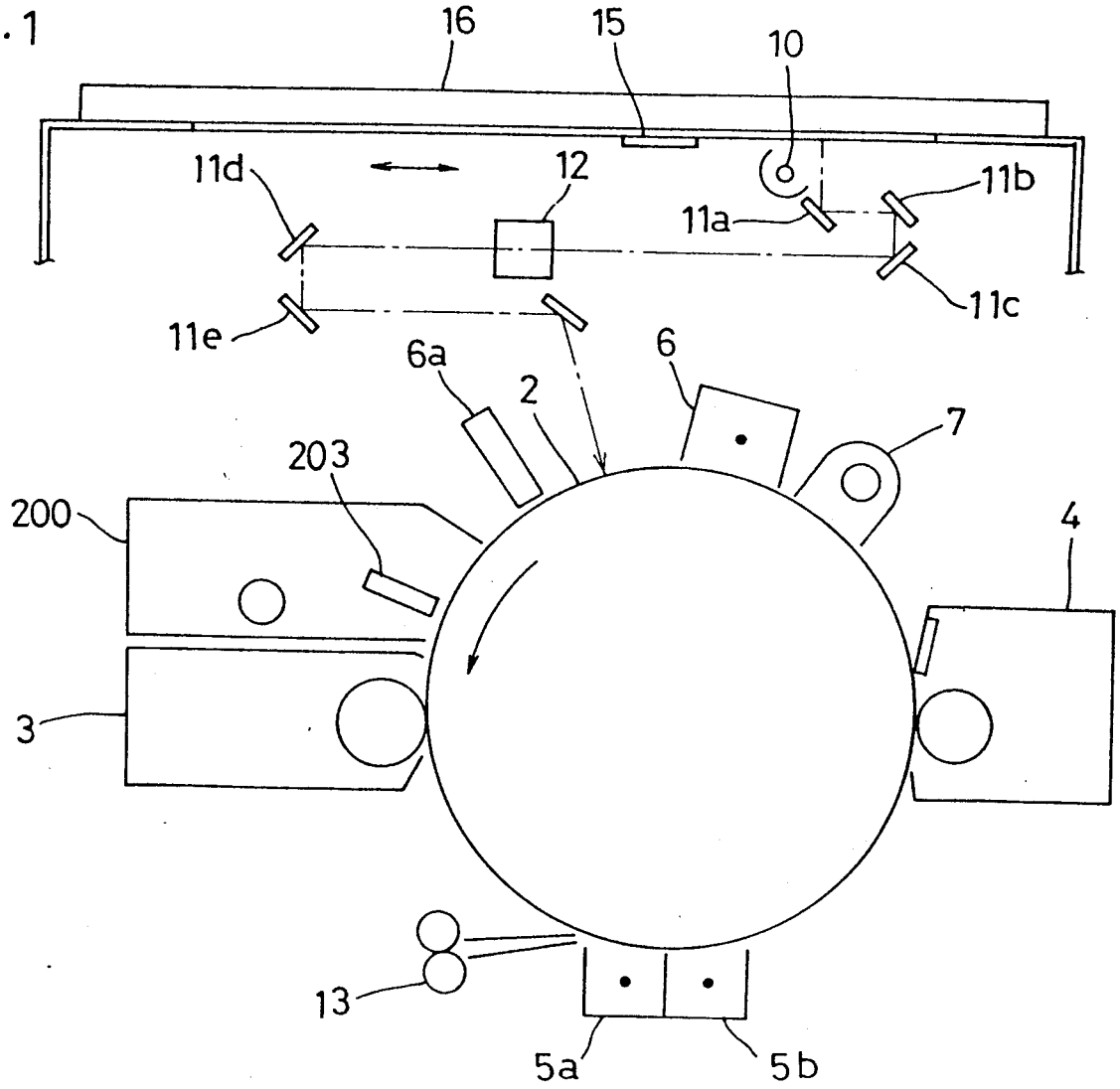
FIG. 1 is a schematic illustration of a copier having an additional information recording device according to the present invention.

FIG. 1 shows an outline of an electrophotographic copier embodying the present invention.

Figure 2:
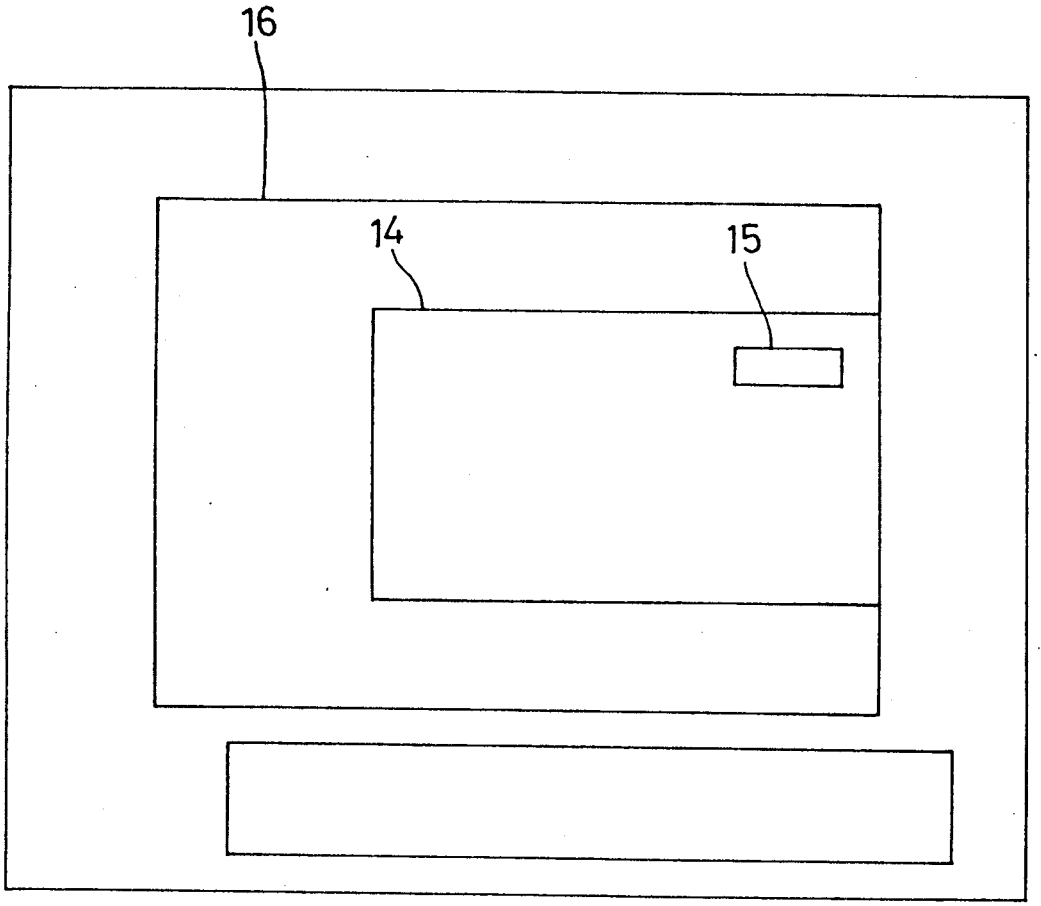
FIG. 2 is an explanatory view showing a seal applied to an original supporting glass table.

The copier comprises a glass table 16 for supporting an original to be copied. A black seal 15 is applied to a bottom surface of the glass for shutting off or absorbing illuminating light directed to the original. This seal 15 serves to prevent the electric charge of an information recording region of a photoreceptor drum 2 from being erased by exposure of an original image, and is applied to a position of the glass table 16 corresponding to an additional information recording position selected by a user. When, as shown in FIG. 2, the user selects a corner of original 14 for recording additional information, the seal 15 is applied to a position of the glass table 16 corresponding to the selected corner. Normally, a particular user or users require(s) the additional information to be recorded in a particular region of copied images. The seal 15 is therefore applied by a service engineer or other person to a fixed position on the reverse or bottom face of the glass table 16. Since the seal 15 is simply applied to the reverse face of the glass table 16, no extra space is required.

1-1: Optical System

The illustrated copier comprises an optical system for scanning the original placed on the glass table 16, and projecting the original image onto the surface of a photoreceptor drum 2 through reflecting mirrors 11*a*–11*f* and a lens 12.

The optical system includes an exposure lamp 10 besides the reflecting mirrors 11*a*–11*f* and the lens 12.

The exposure lamp 10 and mirrors 11*a*, 11*b* and 11*c* are reciprocable under the glass table 16 in the directions indicated by a double-head arrow in FIG. 1. The exposure lamp 10 and mirror 11*a* are movable at velocity V/N where V is a peripheral velocity of the photoreceptor drum 2 and N is a copying magnification, whereas the mirrors 11*b* and 11*c* are movable at velocity V/2N. The original is scanned during the forward movement of these elements.

1-2: Image-Forming Section

The copier further comprises an image-forming section for forming images in an electrophotographic process. That is, an electrostatic latent image is developed with toner for transfer to copying paper.

The image-forming section is arranged around the photoreceptor drum 2 which is cylindrical and rotatable in the direction indicated by an arrow. Specifically, the drum 2 is surrounded by an eraser lamp 7, a charger 6, an inter-image eraser 6*a*, an information recording device 200 including an information recording LED array 203, a developing device 3, a transfer charger 5*a*, a separating charger 5*b* and a cleaning device 4. Reference numeral 13 denotes a timing roller pair for feeding copying paper with an appropriate timing to a position between the photoreceptor drum 2 and the transfer charger 5*a*.

1-3: Image-Forming Process

First, the charger 6 uniformly charges the surface of the photoreceptor drum 2. Then an electrostatic latent image corresponding to the original image is formed on the drum 2 through exposure to the original image, and the inter-image eraser 6*a* erases the charge of blank portions of the image. The region on the drum 2 corresponding to the seal 15 (i.e. the region for receiving the additional information) remains charged after the exposure since the seal 15 shuts off the illuminating light.

Next, the LED array 203 is driven to record the additional information in the charged region, whereby an electrostatic latent image corresponding to an additional information pattern is formed thereon. When no additional information is recorded, all elements of the LED array 203 are turned on for entirely erasing the charge of the additional information recording region, so that the image of the seal 15 will not appear upon development of the latent image.

Subsequently, the developing device 3 develops the latent image with toner, the transfer charger 5*a* transfers the toner image to the copying paper, the separating charger 5*b* separates the copying paper from the drum 2, and the cleaning device 4 removes residual toner from the drum 2. Finally, the eraser lamp 5 eliminates residual charge from the drum 2, to complete one image-forming cycle.

2: Positioning of LED array

Figure 3:
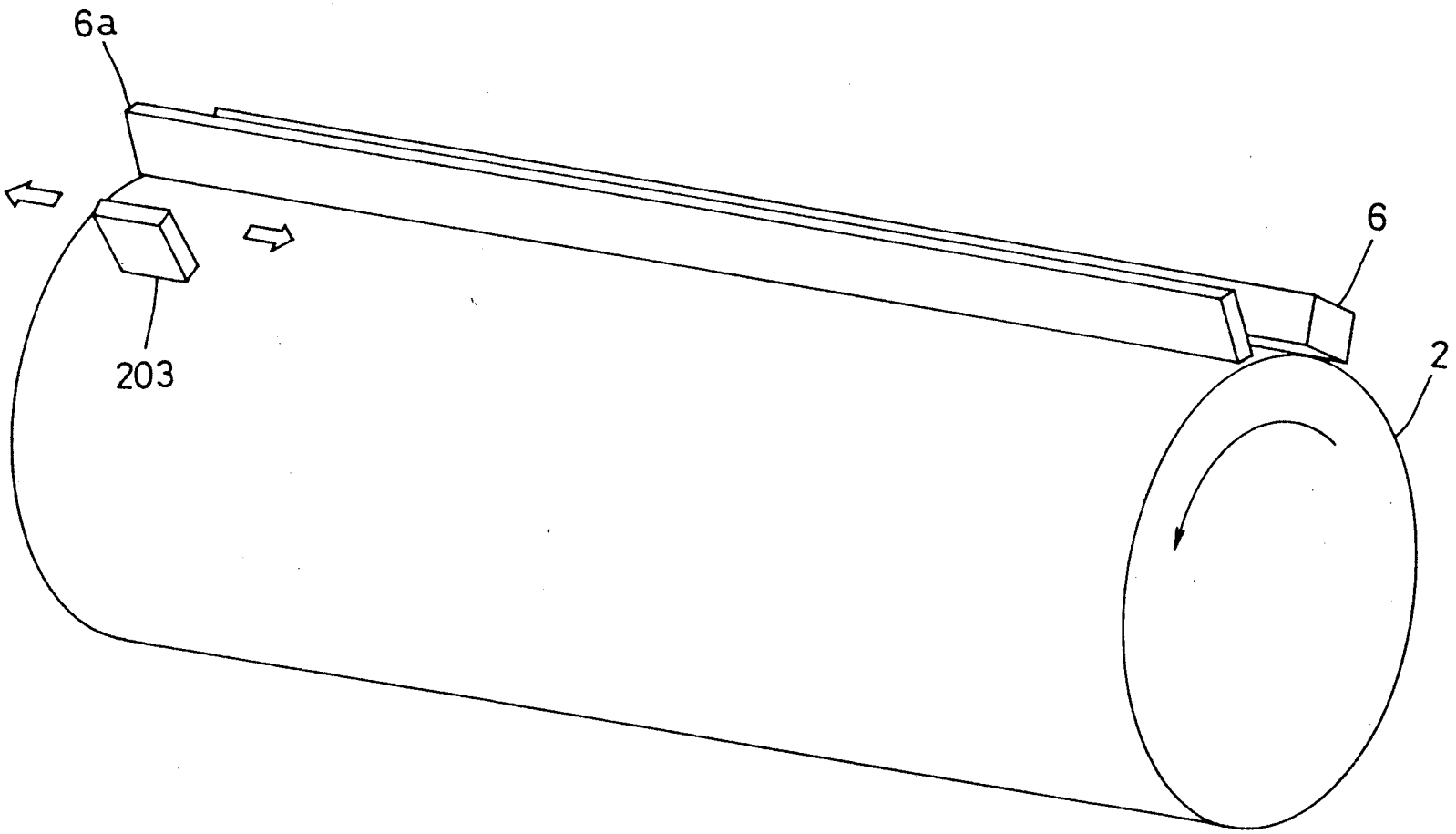
FIG. 3 is an explanatory view showing a positional relation between an LED array and a photoreceptor drum.
Figure 4:
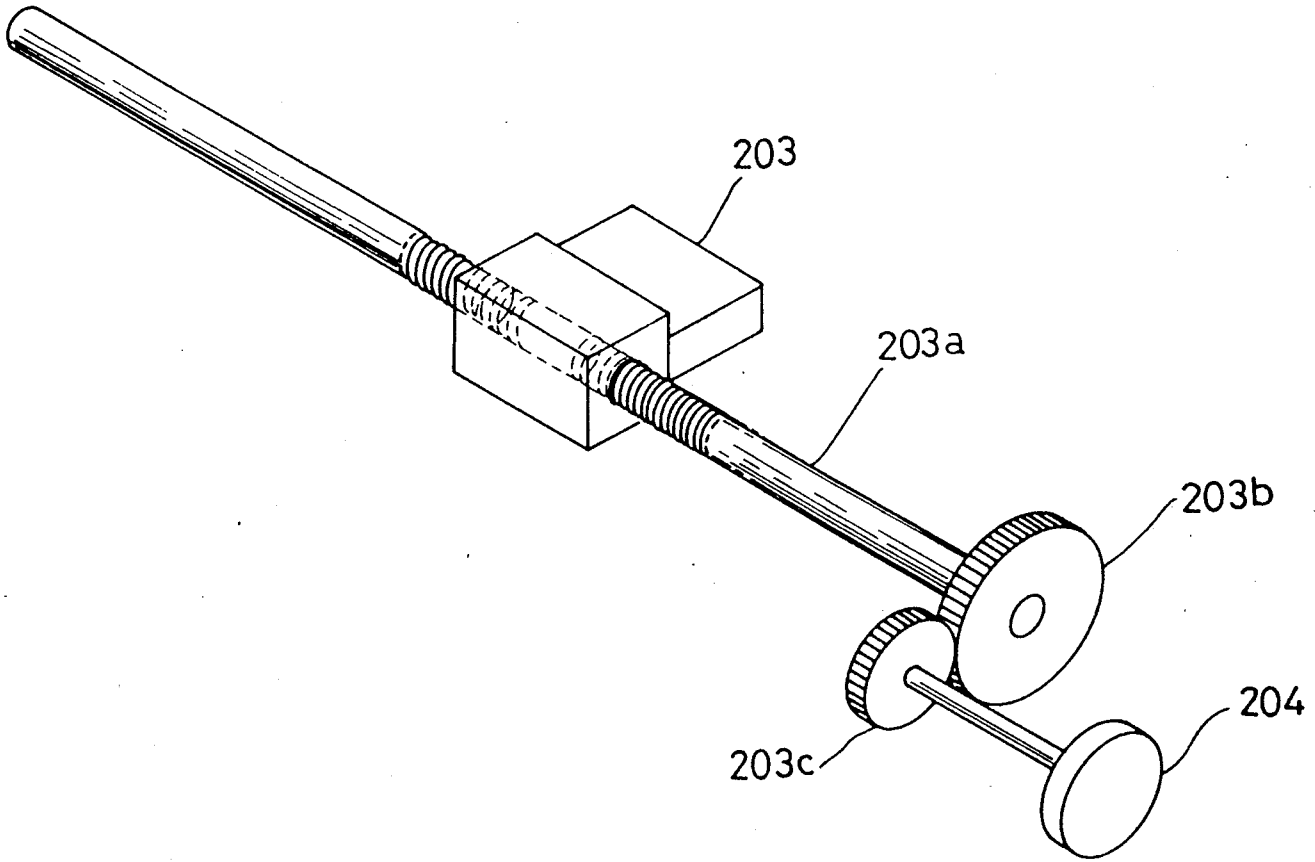
FIG. 4 is a perspective view of a mechanism for setting the position of the LED array.

FIG. 3 is an explanatory view showing a positional relation between the LED array 203 and photoreceptor drum 2, and FIG. 4 is a perspective view of a mechanism for setting the position of the LED array 203.

As shown in FIG. 3, the LED array 203 is disposed adjacent the photoreceptor drum 2 between the inter-image eraser 6*a* and developing device 3 (FIG. 1). The LED array 203 includes a plurality of light emitting diodes arranged axially of the drum 2.

Further, the LED array 203 is movable axially of the drum 2 by the mechanism shown in FIG. 4. As seen, the LED array 203 is supported in meshing engagement on a support shaft 203*a* which is rotatably connected through a meshing pair of gears 203*b* and 203*c* to a motor 204. With the rotation of the shaft 203*a*, the LED array 203 is movable along the shaft 203*a* (i.e. axially of the drum 2) relative to the drum 2. In this way, the LED array 203 may be set to a position corresponding to the seal 15 applied to a position of the glass table 16 selected in accordance with a range for recording the additional information.

The motor 204 may be replaced by a control knob for manually rotating the support shaft 203*a* (i.e. for manually moving the LED array 203).

3: Control Circuitry

Figure 5:
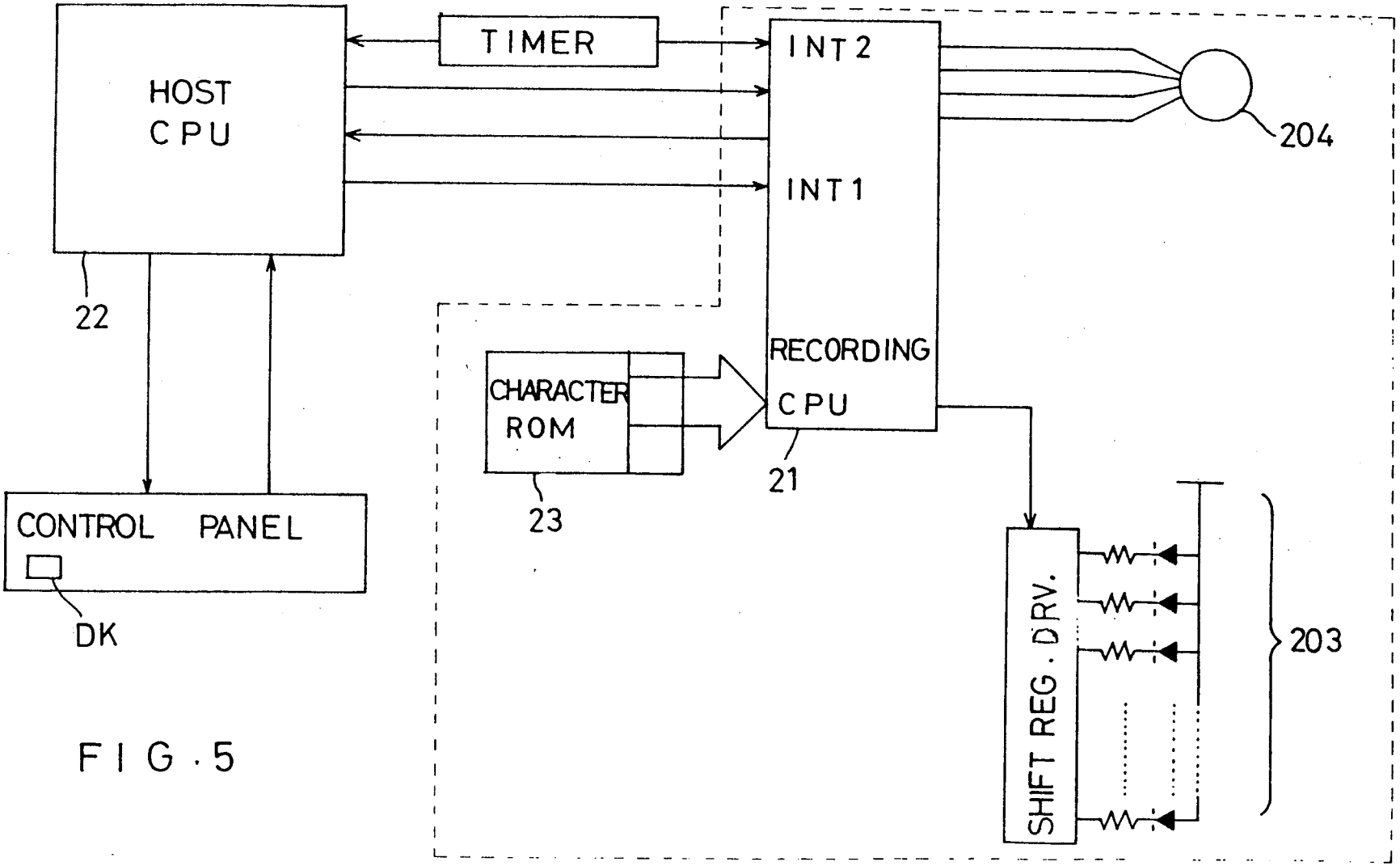
FIG. 5 is a block diagram of a control circuitry mounted in the copier.

FIG. 5 is a block diagram of a control circuitry mounted in the copier.

This control circuitry includes, as main components thereof, a host CPU 22 for controlling an overall operation of the copier, and a recording CPU 21 for controlling the additional information recording device 200. The copier has a control panel including a record mode key DK for inputting an instruction as to whether the additional information should be recorded or not. The additional information is recorded if an information recording mode is set through this mode key DK. Otherwise the additional information is not recorded.

The host CPU 22 receives various key input signals from the control panel, time data from a timer circuit, timing data from the recording CPU 21, and signals from various sensors mounted in the copier. Further, the host CPU 22 transmits display signals to the control panel, data to the recording device 200 such as position data (where the LED array 203 is moved by the motor) and image data, an image area interrupt request signal to the recording CPU 21, and control signals to various devices such as the scanning and projecting optical system, the developing device, a fixing device and so on arranged at various positions inside the copier.

The recording CPU 21 receives, in addition to the signals from the host CPU 22, a timer interrupt request signal from the timer circuit, and font data from a character ROM. Further, the recording CPU 21 transmits, in addition to the signals transmitted to the host CPU 22, a drive control signal to a stepper motor 204, and ON/OFF data to a driver for driving the LED array 203.

4: ON/OFF Control of LED Array 203

The recording CPU 21 carries out an ON/OFF control of the LED array 203 as follows:

4-1: Image Area Interrupt

Figure 6:
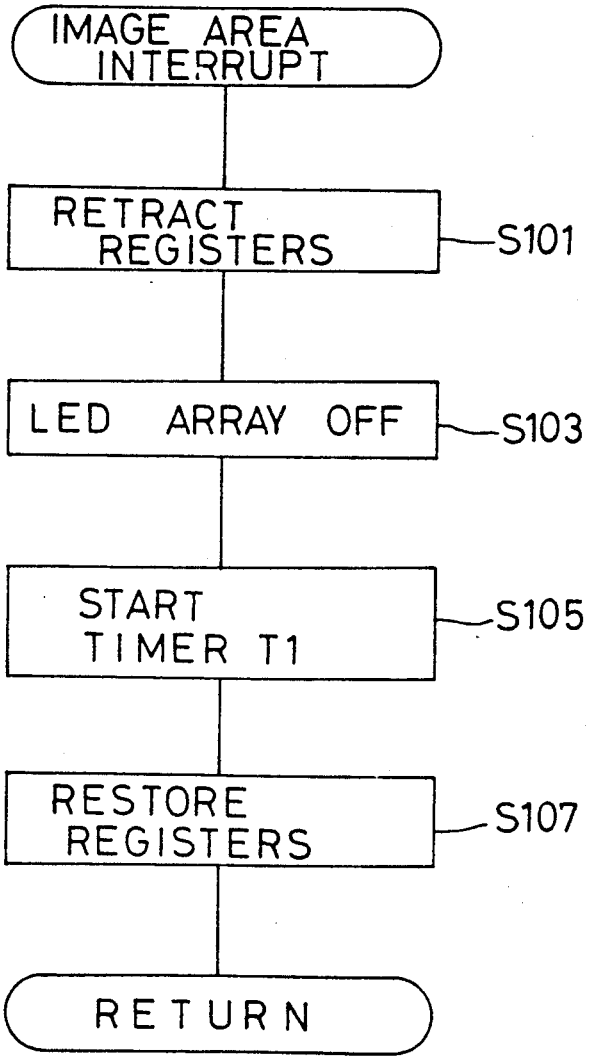
FIG. 6 is a flow chart of an image area interrupt routine, and FIGS. *7a* and *7b* are flow charts of a timer interrupt routine.

FIG. 6 is a flow chart of an interrupt service routine executed by the recording CPU 21 in response to the image area interrupt request signal received from the host CPU 22. The image area interrupt request signal is generated when the scanning movement reaches a leading end of the image.

Upon receipt of the interrupt request signal from the host CPU 22, the recording CPU 21 discontinues whatever processing is being carried out and initiates the interrupt service routine.

First, various registers are retracted at step S101. This step is taken for resuming the discontinued processing after completing the interrupt processing. Next, all the light emitting diodes of the information recording LED array 203 are turned off at step S103. Further, a timer T1 controlled by the timer circuit is started at step S105. The timer T1 is set to a value t1 corresponding to a period of time taken for the photoreceptor drum 2 to rotate from the leading end of the image to a position for starting additional information recording.

The timer circuit transmits a hardware interrupt request signal to the recording CPU 21. Upon receipt of this signal, the CPU 21 executes a timer interrupt routine to be described later.

After completing the above processing, the registers are restored at step S107 for resuming the discontinued processing.

4-2: Timer Interrupt Routine

Figure 7A:
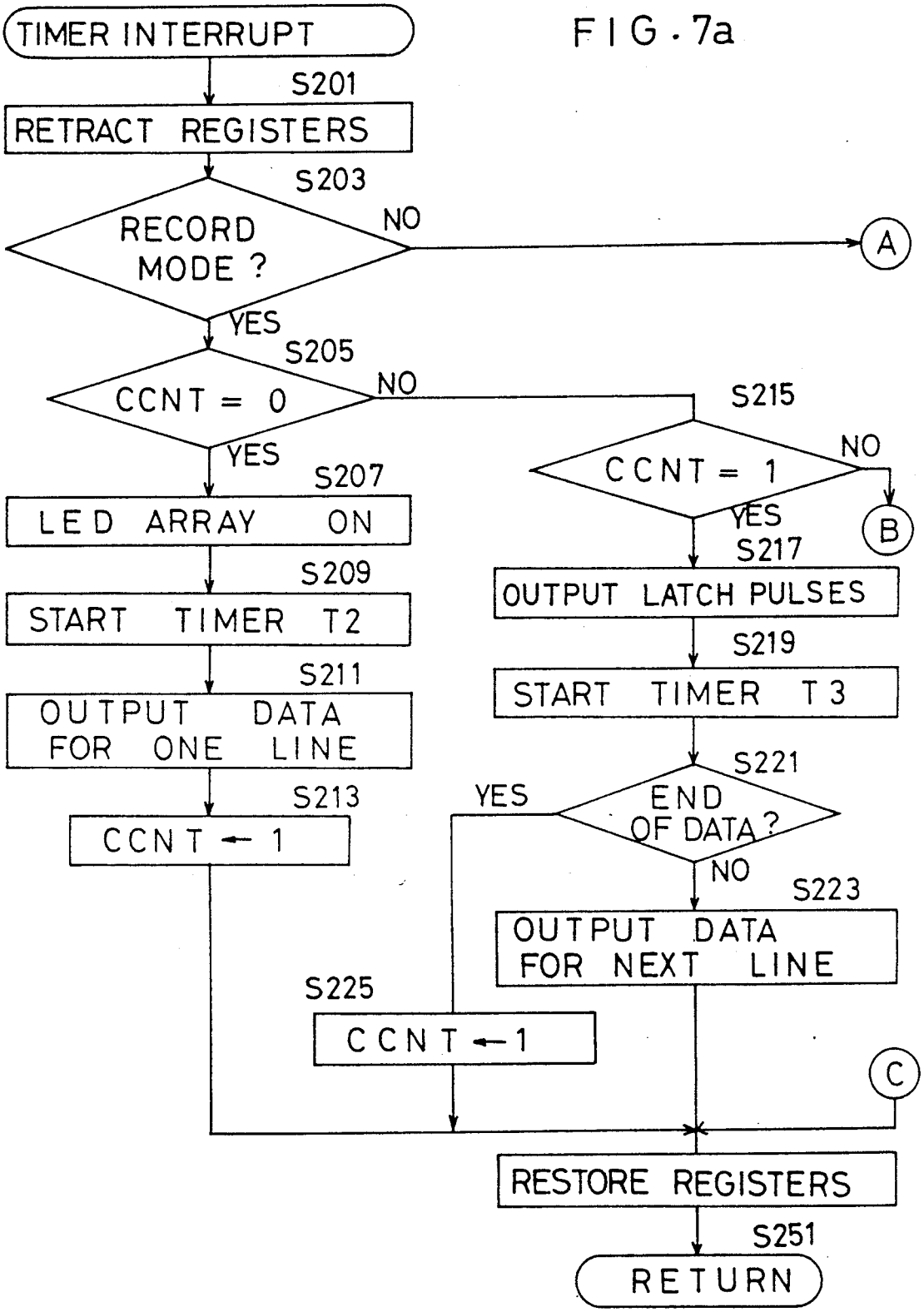
Figure 7B:
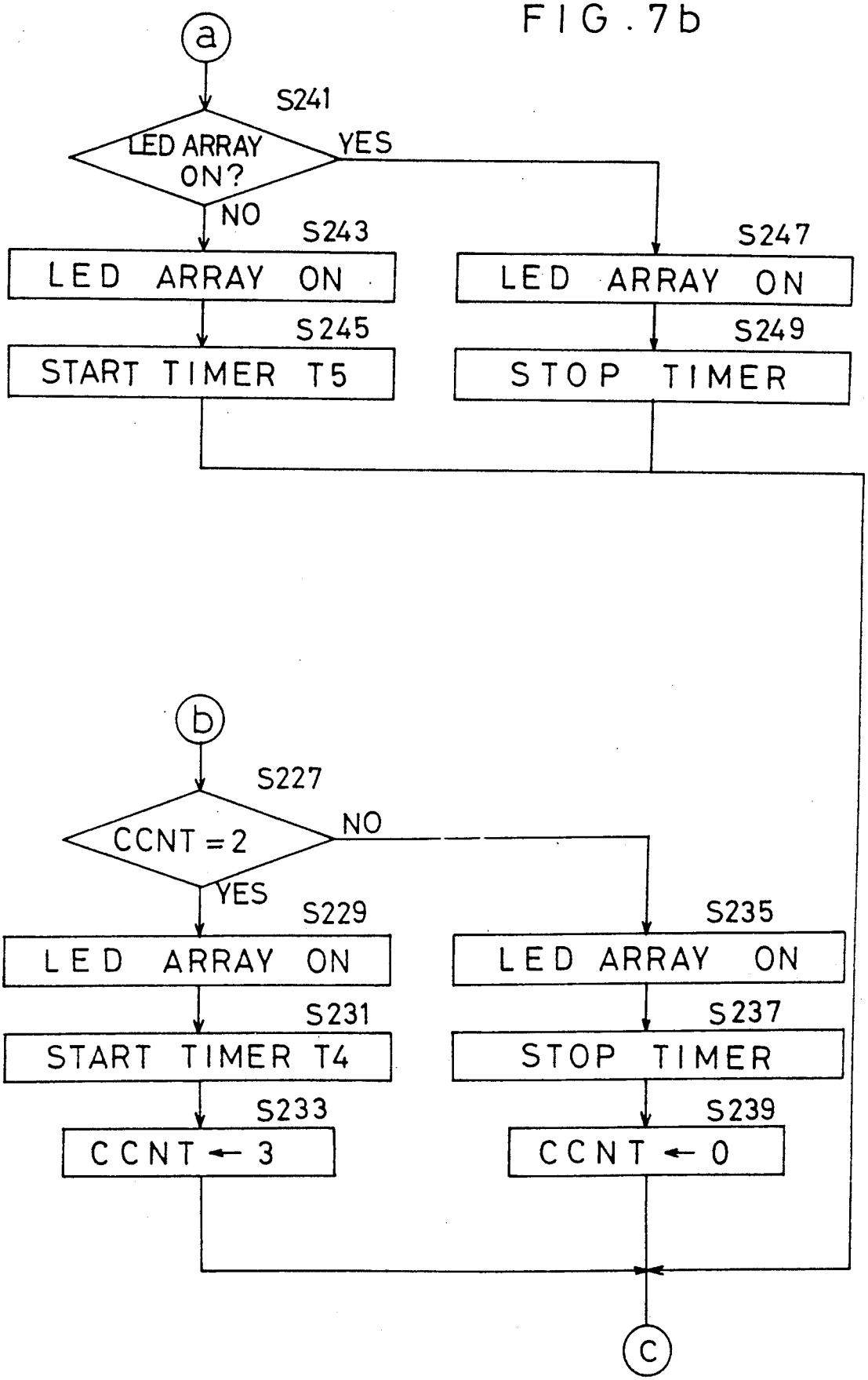

FIGS. 7*a* and 7*b* are flow charts of the timer interrupt routine.

This routine is an interrupt service routine executed by the recording CPU 21 in response to the interrupt request signal received from the timer circuit and with completion of the timer T1 started in the course of the image area interrupt routine or of timers T2–T5 started in the course of the timer interrupt routine. Upon receipt of the interrupt request signal from the timer circuit, the recording CPU 21 discontinues whatever processing is being carried out and initiates this interrupt service routine.

First, the registers are retracted at step S201. This step is taken for resuming the discontinued processing after completing the interrupt processing.

Next, judgment is made at step S203 whether the additional information recording mode has been set or not. This judgment is necessary since different processes are carried out for controlling the LED array 203 depending on whether the information recording mode has been set or not.

More particularly, if the additional information recording mode has not been set, a processing is carried out at steps S241 through S249 for masking the information recording region. If the additional information recording mode has been set, a processing is carried out at steps S205 through S239 for recording the additional information on the information recording region.

4-2-1: When Additional Information Recording Mode Is Not Set

When the additional information recording mode has not been set, the program moves from step S203 to steps S241 et seq. for masking the recording region.

The masking processing is carried out in order to prevent the image of the seal 15 from being copied onto the copying paper.

If step S241 finds all the light emitting diodes of the LED array 203 turned off, step S243 is executed to turn on all the light emitting diodes, and step S245 to start the timer T5. As a result, the LED array 203 is driven till completion of the timer T5 for removing the electric charge from the information recording region. The timer T5 is set to a value t5 corresponding to a period of time for the photoreceptor drum 2 to rotate through the length of the image recording region (i.e. the length in the circumferential direction of the drum 2).

After completing the above processing, the registers are restored at step S251 for resuming the discontinued processing.

When the timer interrupt routine is executed with completion of the timer T5 (i.e. after the charge is removed from the information recording region), the program moves from step S201 through steps S203 and S241 to step S247 for turning on all the light emitting diodes. Then the timer count is stopped at step S249 for masking the timer interrupt. In this way, the masking processing is carried out for the additional information recording region.

4-2-2: When Additional Information Recording Mode Is Set

When the additional information recording mode has been set, the program moves from step S203 to step S205 for checking a flag: CCNT to carry out an operation according to its value. CCNT is initially set to zero.

4-2-2-1 Processing for Unstable Potential Position at Leading End (CCNT=0)

If step S205 finds that CCNT is zero, the program moves to step S207 for turning on all the light emitting diodes of the LED array 203, and to step S209 for starting the timer T2. As a result, the LED array 203 removes the electric charge from an unstable potential position at the leading end of the information recording region. That is, the timer T2 is set to a sufficient value for avoiding recording of the additional information at the unstable potential position.

Thereafter, at step S211, information for recording one line (ON/OFF control data for one dot length of each light emitting diode) is output to a shift register in the LED array 203. Then CCNT is set to "1" at step S213.

After completing the above processing, the registers are restored at step S251 for resuming the discontinued processing.

4-2-2-2 Processing for Recording Additional Information (CCNT=1)

When this routine is executed with completion of the timer T2 (i.e. after the electric charge is removed from the unstable potential position), the program moves from step S205 through step S215 to step S217 for outputting latching pulses to the shift register. As a result, the shift register outputs an ON/OFF control signal to the driver for driving the LED array 203.

Then the timer T3 is started at step S219. The timer T3 is set to a value t3 which is a period of time corresponding to one dot length of a dot matrix font. That is, with completion of the timer T3, a timer interrupt occurs for a next line, for recording the additional information.

Step S221 judges whether or not the font data has been output to the last line to the shift register.

If the data output has not been completed yet, a font data for the next line is output to the shift register at step S223. Then the program moves to step S251 for restoring the registers to resume the discontinued processing.

When this routine is executed with completion of the timer T3 (i.e. the information recording is continued), the program repeats steps S215, S217, S219, S221, S223 and S251.

If, on the other hand, step S221 finds that all the data has been output, CCNT is set to "2" at step S225. Then the program moves to step S251 for restoring the registers to resume the discontinued processing.

4-2-2-3: Processing for Unstable Potential Position at Trailing End (CCNT=2)

If step S227 finds that CCNT is "2", the program moves to step S229 for turning on all the light emitting diodes of the LED array 203, and to step S231 for starting the timer T4. As a result, the LED array 203 removes the electric charge from an unstable potential position at the trailing end of the information recording region. The timer T4 is set to a sufficient value for removing the electric charge from the unstable position at the trailing end.

After completing the above processing, CCNT is set to "3" at step S233 and the registers are restored at step S251. Then this routine is finished for resuming the discontinued processing.

When this routine is executed with completion of the timer T4 (i.e. after the electric charge is removed from the unstable potential position), the program moves from step S227 to step S235 for turning off all the light emitting diodes. Then the timer count is stopped at step S237 for masking the timer interrupt, and CCNT is set to zero at step S239.

The additional information recording control is effected through the timer interrupt processing as described above.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrophotographic copier having a charger for uniformly charging a photoreceptor, a first mechanism for projecting an original image onto the charged photoreceptor to form an electrostatic latent image corresponding to the original image on the photoreceptor, and a second mechanism for forming an electrostatic latent image corresponding to an electric signal indicative of additional information on the photoreceptor, said second mechanism comprising;

charge retaining means for retaining electric charge of a selected region of said photoreceptor by partially intercepting the original image projected by said first mechanism, said charge retaining means being fixedly provided at a position corresponding to said selected region where said additional information is to be recorded; and an exposure head operable in a first operating mode for exposing said selected region of said photoreceptor in accordance with said electric signal, and a second operating mode for erasing the charge of said selected region regardless of said electric signal, said exposure head being adjustable to a position for exposing said selected region.

2. A copier as claimed in claim 1, wherein said charge retaining means comprises a seal removably applied to a bottom face of an original-supporting glass table.

3. A copier as claimed in claim 1, further comprising an adjusting mechanism for moving said exposure head to a position corresponding to the position at which said charge retaining means is fixed.

4. A copier as claimed in claim 1, further comprising a mode key provided on a control panel for setting an additional information recording mode, said additional information being recorded only when the additional information recording mode is set by said mode key.

5. A copier as claimed in claim 4, wherein said exposure head comprises an LED array.

6. A copier as claimed in claim 5, wherein said LED array includes light emitting diodes all of which are driven for erasing the charge of said selected region of said photoreceptor when said additional information recording mode is off.

7. A copier as claimed in claim 6, wherein said LED array is driven for emitting light to a leading end and a trailing end of said selected region of said photoreceptor to erase charges thereof when said additional information recording mode is not set.

8. An electrophotographic copier comprising:

an original-supporting table including an original supporting region for supporting an original;

a rotatable photoreceptor;

means for charging said photoreceptor;

means for illuminating the original placed on said original supporting table;

means for exposing said photoreceptor as charged to an image of the original as illuminated, thereby forming an electrostatic latent image corresponding to the original image on said photoreceptor;

a light-absorbing member provided on a selected position in said original-supporting region of said original-supporting table for absorbing light from said illuminating means, electric charge of a selected region of said photoreceptor corresponding to said light-absorbing member being retained through the exposure of said photoreceptor;

means for setting an additional information recording mode;

a recording head disposed downstream of a position of exposure by said exposing means with respect to a direction of rotation of said photoreceptor, said recording head being operable for exposing said selected region of said photoreceptor in accordance with an electric signal indicative of additional information when said additional information recording mode is set, and for erasing the charge of said selected region when said additional information recording mode is off;

means for adjusting said recording head to a position for exposing said selected region of said photoreceptor;

developing means disposed downstream of the position of exposure by said exposing means with respect to the direction of rotation of said photoreceptor for developing the electrostatic latent image on said photoreceptor; and means for transferring the developed image to copying paper.

9. A copier as claimed in claim 8, wherein said light-absorbing member comprises a seal removably applied to a bottom face of an original-supporting table.

10. A copier as claimed in claim 8, wherein said mode setting means comprises a mode key provided on a control panel for setting said additional information recording mode, said additional information being recorded only when the additional information recording mode is set by said mode key.

11. A copier as claimed in claim 10, wherein said recording head comprises an LED array including light emitting diodes all of which are driven for erasing the charge of said selected region when said additional information recording mode is off.

12. An electrophotographic copier comprising:

an original-supporting table on which an original is placed;

a photoreceptor;

means for projecting an image of the original placed on said original-supporting table onto the photoreceptor;

a light-absorbing member fixedly provided on said original-supporting table so as to prohibit a part of the image of the original from being projected onto the photoreceptor to thereby provide a non-exposed region on the photoreceptor;

a recording head for exposing said non-exposed region of the photoreceptor according to an additional information;

mode setting means for setting an additional information recording mode; and control means responsive to said mode setting means for controlling said recording head so as to expose said non-exposed region according to the additional information when said additional information recording mode is set and to erase the whole electric charge of said non-exposed region when the additional information recording mode is off, whereby the additional information is recorded only when the additional information recording mode is set.

* * * * *